US010145182B2

(12) United States Patent
Yang et al.

(10) Patent No.: US 10,145,182 B2
(45) Date of Patent: Dec. 4, 2018

(54) LANDING PIPE

(71) Applicant: VAM DRILLING USA, INC., Houston, TX (US)

(72) Inventors: Henry Yang, Houston, TX (US); Jonathan Franchi, Houston, TX (US); Chris McKlemurry, Houston, TX (US); Kenneth Godeke, Houston, TX (US); Scott Granger, Houston, TX (US)

(73) Assignees: TUBOSCOPE VETCO (FRANCE) SAS, Berlaimont (FR); GRANT PRIDECO, L.P., Houston, TX (US)

( * ) Notice: Subject to any disclaimer, the term of this patent is extended or adjusted under 35 U.S.C. 154(b) by 729 days.

(21) Appl. No.: 13/689,239

(22) Filed: Nov. 29, 2012

(65) Prior Publication Data

US 2014/0145432 A1 May 29, 2014

(51) Int. Cl.
*F16L 15/00* (2006.01)
*E21B 17/00* (2006.01)

(52) U.S. Cl.
CPC ..... *E21B 17/00* (2013.01)

(58) Field of Classification Search
USPC ..... 285/333–334, 355, 390
See application file for complete search history.

(56) References Cited

U.S. PATENT DOCUMENTS 1,714,818 A * 5/1929 Reed ..... E21B 17/043 285/333
3,080,179 A * 3/1963 Huntsinger ..... E21B 17/00 138/155
3,193,918 A * 7/1965 Heldenbrand ..... 228/182
3,773,359 A * 11/1973 Chance et al. ..... 285/288.1
3,784,238 A * 1/1974 Chance et al. ..... 285/288.1
4,364,587 A * 12/1982 Samford ..... 285/3
4,674,171 A * 6/1987 DeCell ..... B23P 15/00 138/172
4,760,889 A * 8/1988 Dudman ..... 175/320
4,771,811 A 9/1988 DeCell et al.
4,987,961 A 1/1991 McNeely, Jr.
5,148,876 A * 9/1992 Wilson ..... 175/76
RE37,167 E 5/2001 Wilson
(Continued)

FOREIGN PATENT DOCUMENTS

WO WO 96/01386 A1 1/1996

OTHER PUBLICATIONS

European Search Report dated May 27, 2013 in Patent Application No. 13151249.

(Continued)

*Primary Examiner* — Aaron M Dunwoody
*Assistant Examiner* — Fannie C Kee
(74) *Attorney, Agent, or Firm* — Conley Rose, P.C.

(57) ABSTRACT

A landing pipe includes a first tool joint, a second tool joint, and a main section extending from the first tool joint to the second tool joint, the main section having a first portion and a second portion. The first tool joint outer diameter is greater than both the main section first portion outer diameter and the main section second portion outer diameter. The main section first portion wall thickness is greater than the main section second portion wall thickness, and the main section second portion has a length range of 40% to 85% of an overall length of the landing pipe.

18 Claims, 3 Drawing Sheets

(56) References Cited

U.S. PATENT DOCUMENTS

| | | | | |
|---|---|---|---|---|
| 2004/0074647 | A1 | 4/2004 | Adams et al. | |
| 2010/0308577 | A1 | 12/2010 | Chin | |
| 2011/0083841 | A1* | 4/2011 | Prokopchuk ..... | E21B 17/1078 166/242.6 |

OTHER PUBLICATIONS

International Search Report dated Nov. 7, 2014 in PCT/IB2013/002649.

* cited by examiner

LANDING PIPE

BACKGROUND

The present invention relates to a tubular component used for drilling and operating hydrocarbon wells and landing heavy loads in a well or on or below the sea bed. The term "drill string or landing string component" means any element with a substantially tubular shape intended to be connected to another element of the same type or not in order, when complete, to constitute either a string for drilling or performing operations within a hydrocarbon well or a string for landing heavy loads in a well or on or below the sea bed. The invention is of particular application to other components used in a drill string or landing string such as drill pipes, heavy weight drill pipes, drill collars, and the parts of drill pipes, heavy weight drill pipes, and landing pipes which allow connection, and known as tool joints.

When a drill string is taken apart, removed, or connected, gripping slips are used to grip an area on the drill string or landing string component below the component being removed from, or connected to, the drill string or landing string.

Gripping slips have inserts with teeth to clamp the drill string or landing string component below the drill string or landing string component being removed or reconnected, and hold up the unsupported weight of the string below the slips. Due to repeated gripping of certain drill string or landing string components by the gripping slips, the area of the drill string or landing string component where gripping takes place may be more subject to fatigue failure from repetitive loading and unloading, and notching from each application of the slips' teeth. Accordingly, manufacturing a drill string or landing string component with a suitably long part life is challenging, since the components in a drill string or landing string must be capable in many cases of withstanding high tensile and compressive loads, bending and rotation under stress, as well as frequent slips clamping which results in hoop stresses, notching, and potential crushing of the drill string or landing string component.

U.S. Pat. No. 3,080,179 that issued Mar. 5, 1963 to C. F. Huntsinger claims a drill pipe construction with a thick-walled protector tube in the slip area of the drill pipe.

U.S. Pat. No. RE 37,167 re-issued May 8, 2001, to G. E. Wilson also claims an increased wall thickness steel protector tube for drill pipes, thus improving resistance to crack initiation and propagation.

Specifically Wilson proposed:

> "a thick wall rotary slip engaging elongated steel protector tube extending from the first tool joint to the main portion of the drill pipe, the protector tube having greater wall thickness than the main portion of the drill pipe, the protector tube being made of a Martensite steel having a small, close knit, grain size to reduce the penetration of the slip teeth that engage the protector tube when the joint is supported in the rotary table by slips"

Wilson obtains a drill pipe with the protector tube that will run its full expected fatigue life without failing in notches and marks caused by slips in the rotary table.

Accordingly, increasing tube wall thickness where slips are applied on a landing pipe increases the landing pipe's resistance to stresses applied by the slips while the landing pipe is in tension. A trade-off between resistance to stresses and weight is needed to select tube wall thickness in the region where slips are to be applied.

Use of a material with a high Rockwell Hardness (HRC) makes the material stronger and the pipe more resistant to slip crushing, but more brittle and less resistant to crack initiation, and crack propagation, which may result from applying slips. In practice, yield strength ranges can be selected and the pipe treated accordingly to meet the desired material characteristics.

SUMMARY

It is an object and feature of an exemplary embodiment described herein to provide a reduced weight landing pipe capable of maintaining high tensile loads. It is another object and feature of an exemplary embodiment described herein to provide a landing pipe less prone to fatigue and cracks. It is further an object and feature of an exemplary embodiment described herein to provide a landing pipe that improves landing operations.

One advantage of an exemplary embodiment described herein lies in reducing landing pipe weight, which reduces loading of drill string and landing string components and other handling equipment and drilling rig components. Reducing pipe weight can increase part life and extend the potential reach of the landing string. Another advantage of an exemplary embodiment described herein is an integral pipe design, where the pipe is designed with no welds. Identifying the location of a weld while running a landing pipe may increase the time required to run the pipe. In contrast, an integral design provides a larger vertical tolerance to apply the slips, such that it takes less time to set the landing pipe in the slips, leading to faster operations on a string.

In addition, an integral design yields a smoother bore with potentially less hydraulic turbulence, and less hang-up for tools.

These and other objects, advantages, and features of an exemplary embodiment described herein will be apparent to one skilled in the art from a consideration of this specification, including the attached drawings and the appended Claims.

A landing pipe comprises a first tool joint, a second tool joint, and a main section extending from the first tool joint to the second tool joint. In an exemplary embodiment the first tool joint can be an upper tool joint and the second tool joint can be a lower tool joint, or vice versa. The first tool joint outer diameter is greater than the largest main section outer diameter, and a first portion of the landing pipe main section has a greater tube wall thickness than a second portion of the landing pipe main section. In one embodiment, the tube wall thickness of the second portion of the landing pipe main section is reduced by boring the inner diameter. In another embodiment, the tube wall thickness of the second portion of the landing pipe main section is reduced by turning the outer diameter. In other embodiments, part of the first portion of the landing pipe main section can also have a reduced tube wall thickness directly adjacent to the first tool joint.

In an exemplary embodiment, the length of the second portion of the main section is between 40-85% of the overall landing pipe length, which provides sufficient length to set the slips. In a preferred embodiment, the length of the second portion of the main section is between 55-80% of the overall landing pipe length.

BRIEF DESCRIPTION OF THE DRAWINGS

The characteristics and advantages of the invention are set out in more detail in the following description, made with reference to the accompanying drawings.

DETAILED DESCRIPTION OF THE PREFERRED EMBODIMENTS

The present invention comprises a landing pipe designed to minimize weight. The present invention proposes an advantageous trade-off between wall thickness and overall weight, such that the landing pipe's resistance to crushing, tensile yielding, and fatigue is improved, yet the weight is manageable.

Figure 1:
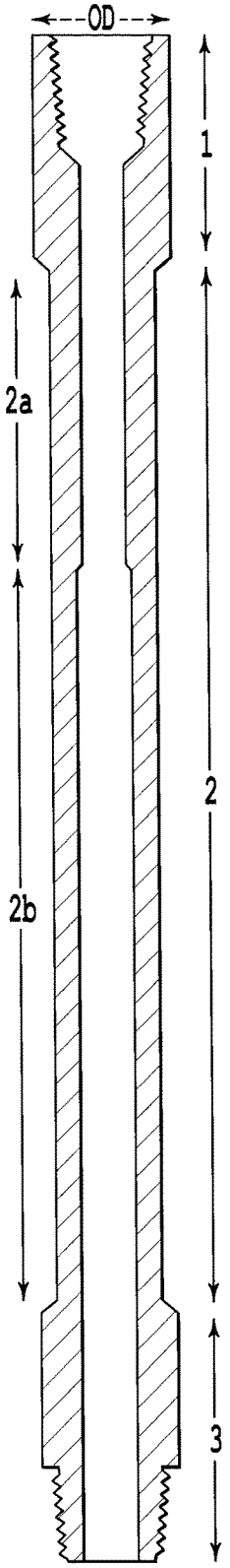
FIG. 1 depicts a schematic cross-sectional view of a first embodiment.

Referring to FIG. 1, an exemplary landing pipe is composed of an upper tool joint (1), a main portion consisting of a first portion (2*a*), where slips are intended to engage the landing pipe, a second portion (2*b*), which has a lower tube wall thickness than the main portion to reduce weight, and a lower tool joint (3). Tool joints may be of the pin and box type, and threaded, to allow mating of multiple landing pipes to form a drill string or landing string.

In a preferred embodiment, the material used for the landing pipe is a high strength low alloy (HSLA) material such as 4100 or 4300 series alloy steel.

An exemplary embodiment of the present invention uses an integral design, defined as a design without welds. In an exemplary embodiment, no weld is present on the landing pipe between the main section first portion and the main section second portion. In a preferred embodiment no welds are present between the tool joints and main section such that the landing pipe design is entirely integral. Neither Wilson nor Huntsinger discloses a design which is integral in part or as a whole.

An exemplary embodiment of the present invention may have both an integral design and different mechanical characteristics along its length. The tube main section (2) requires a high yield strength to ensure a balance between pipe weight and resistance to tensile loads. A preferred embodiment of the present invention may use a main section with a higher yield strength, and tool joints (1, 3) with a lower yield strength. In an exemplary embodiment of the present invention, tool joints have a greater cross section than the main section, such that a higher force needs to be applied for the tool joint to yield, compared to the force required for the main section to yield. Tool joint threads are prone to damage due to their irregular shape, and use of a lower yield strength may prevent cracks from initiating in the threads.

In a preferred embodiment, the yield strength range (determined by physical testing with 0.2% offset) for the drill pipe's main section is between 135 ksi and 180 ksi. For commercial embodiments, a main section preferred yield strength range is between 150 ksi and 175 ksi. In a preferred embodiment the yield strength range of the tool joints is between 120 ksi and 160 ksi. For commercial embodiments, a tool joint preferred yield strength range is between 135 ksi and 150 ksi.

In an exemplary embodiment of the present invention, desired mechanical characteristics are obtained by first heat treating the entire tube (1,2,3) to obtain the required yield strength for the tube main section (2), and then applying a localized heat treatment on the tool joints (1,3). In an exemplary embodiment of the present invention, the localized heat treatment is applied using inductive coils, or any other method that ensures homogenous heat, both axially and throughout the thickness of the locally treated area. This localized heat treatment uses the same temperature as the heat treatment for the entire tube, with a different treatment time (tempering time) based on the material and thickness used. Tool joints treated with the localized heat treatment described above have lower yield strength and lower material hardness than the pipe's main section. A transition area exists between the low yield strength portions (tool joints) and high yield strength portion (main section), which may be located on the tool joints, preferably 1" from the taper between the tool joint and the pipe main section.

Unlike Huntsinger and Wilson, the proposed invention does not use a protector tube. Indeed, the landing pipe's main section extends from one tool joint to the other tool joint. According to the present invention, the tube wall thickness is not increased. Instead, the present invention reduces the landing pipe weight by removing material from the main section's second portion.

Huntsinger disclosed using a protector tube with lower hardness than the main pipe portion (less notch sensitive), but with a protector cross-section large enough to obtain a total tensile and torsional strength no less than that of the main tube, despite the main tube having higher unit tensile and torsional strength than the protector tube. In other words, Huntsinger disclosed that the main section should have a higher hardness than the protector tube (notching being less of an issue outside of the protector tube). Wilson selected a protector tube with a hardness of 30-38 HRC. The present invention does not use a protector tube. Instead, the present invention can include a single main section between the tool joints. In a preferred embodiment, there is no section between the tool joints with a hardness lower than that of the main section, and there is no section characteristic of a protector tube.

Figure 3:
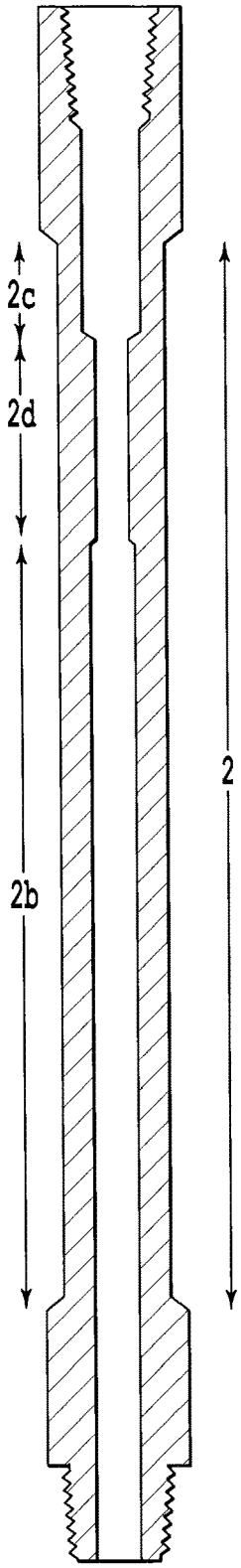
FIG. 3 depicts a schematic cross-sectional view of a second version of the first embodiment.

Referring to FIG. 1, in one exemplary embodiment the present invention utilizes a standard API drill pipe nominal outer diameter (OD) of 6⅝" for the main section, the main section first portion (2*a*) having a constant inner diameter (ID), and the main section second portion (2*b*) having an ID greater than that of the main section first portion. Nominal values can be assigned certain tolerances to accommodate customers and industry specifications. One example of an acceptable manufacturing tolerance is $^{62}/_{1000}$". Field tolerances may be up to 90% of the remaining wall thickness. The main section second portion (2*b*) is bored out, increasing the inner diameter. Referring to FIG. 3, in another version of this embodiment part of the first portion of the main section (2*c*) can also be bored out to an ID greater than the main section first portion to reduce weight, in a region beginning at a first tool joint and finishing at most 36" below the elevator shoulder of the first tool joint, defined as the junction between the main portion and the first tool joint. One advantage of this embodiment is improved landing pipe handling, which results from using a constant drill pipe API OD along the entire main section length.

Figure 2:
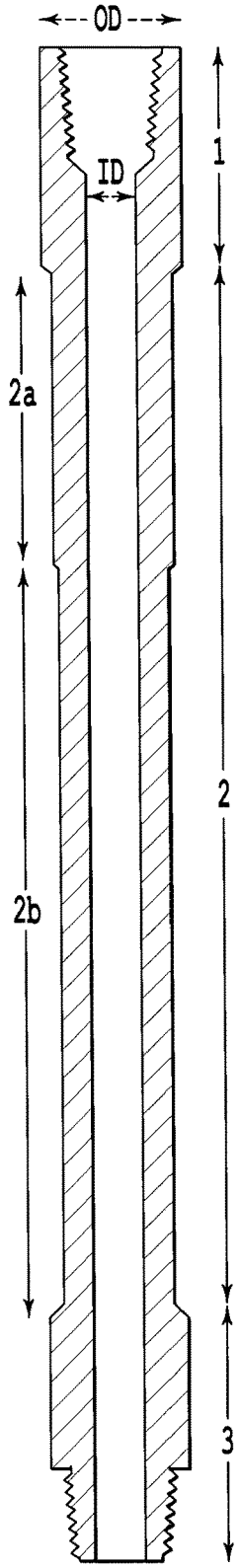
FIG. 2 depicts a schematic cross-sectional view of a second embodiment.

Referring to FIG. 2, in a second exemplary embodiment, the present invention utilizes for the landing pipe main section first portion (2*a*) a non-API drill pipe OD of $6^{29}/_{32}$" nominal, which is compatible with commonly used landing pipe handling equipment on rigs. While the landing pipe in this embodiment displays changes in outer diameter, new generation rigs prevalently can and often use an API compatible elevator and slip system with which the present invention is compatible with certain adjustments.

Figure 4:
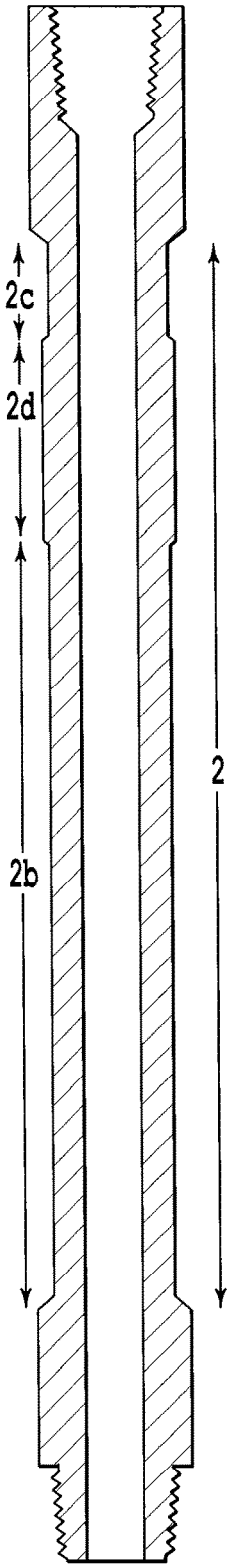
FIG. 4 depicts a schematic cross-sectional view of a second version of the second embodiment.

In the second exemplary embodiment, the main section second portion (2*b*) has a standard API drill pipe nominal OD (6⅝") to reduce weight, rather than a nominal 6²⁹⁄₃₂" OD for the full length of the main section. Referring to FIG. 4, in another version of this embodiment part of the first portion of the landing pipe main section (2*c*) can be turned down to an OD lower than the OD of the second portion (2*b*) of the landing pipe main section to reduce weight, in a region beginning at an upper tool joint elevator shoulder and finishing at most 36" below the elevator shoulder of the upper tool joint. One advantage of this embodiment is the increased landing pipe slips area diameter and the smooth ID bore throughout the length of the landing pipe. In contrast with currently existing drill pipes, a smooth bore, such as the one present in this preferred embodiment, minimizes fluid pressure losses compared to non-integral designs with off-sets and irregularities. The reduction in the OD of the main section first portion directly adjacent to the upper tool joint elevator shoulder can either increase or maintain the elevator shoulder surface area, allowing a modified elevator bore or elevator bushing bore to have an increased or maintained loading capacity with a decreased tool joint OD. The tensile loading capacity for the landing pipe can range from 1.5 million pounds to 4.5 million pounds.

Further, as illustrated FIGS. 3 and 4, the main section 2 can include a third portion (2*d*). In FIG. 3, the third portion (2*d*) has the same OD as the first portion (2*c*) and second portion (2*b*), however, the third portion (2*d*) has an ID lower than both the OD of the first portion (2*c*) and the OD the second portion (2*b*). In FIG. 4, the third portion (2*d*) has the same ID as the first portion (2*c*) and the second portion (2*b*), however, the third portion (2*d*) has an OD greater than the first portion (2*c*) and the second portion (2*b*).

Figure 5:
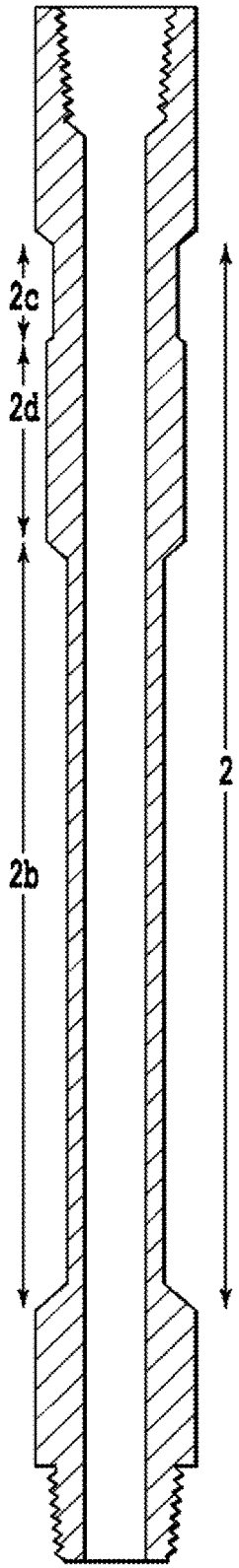
FIG. 5 depicts a schematic cross-sectional view of an embodiment of the invention.

In the embodiment of FIG. 5, the first portion (2*c*) has an OD greater than the OD of the second portion (2*b*).

In both aforementioned exemplary embodiments the wall thickness of the main section second portion is reduced such that the landing pipe weight is reduced by at least 5% compared to a landing pipe with the wall thickness of the main section first portion equal to the main wall thickness of the main section second portion.

In an exemplary embodiment, the length of the second portion (2*b*) of the main section is between 40-85% of the overall landing pipe length, which provides sufficient length to set the slips. In a preferred embodiment, the length of the second portion of the main section is between 55-80% of the overall pipe length. In another preferred embodiment, the length of the second portion of the main section is between 55% and 65% of the overall pipe length.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A landing pipe comprising:

only a single female threaded portion at an upper end of the landing pipe;

only a single male threaded portion at a lower end of the landing pipe;

a first tool joint with a first tool joint outer diameter, the first tool joint comprising a first elevator shoulder;

a second tool joint with a second tool joint outer diameter, the second tool joint comprising a second elevator shoulder; and a main section extending from the first elevator shoulder of the first tool joint to the second elevator shoulder of the second tool joint, wherein an entirety of the main section is located between the female threaded portion and the male threaded portion, said main section having a main section first portion, a main section second portion, and a main section third portion located between the main section first portion and the main section second portion, wherein the main section first portion has a first portion outer diameter, a first portion inner diameter, and a first portion wall thickness;

the main section second portion has a second portion outer diameter, a second portion inner diameter and a second portion wall thickness;

the main section third portion has a third portion outer diameter, a third portion inner diameter and a third portion wall thickness;

the first tool joint outer diameter is greater than both the first portion outer diameter and second portion outer diameter; and the first portion wall thickness is greater than the second portion wall thickness, wherein the main section second portion has a length range of 40% to 85% of an overall length of the landing pipe, wherein the first portion of the main section beginning at the elevator shoulder of the first tool joint and finishing at most 36" below the elevator shoulder of the first tool joint has an outer diameter which is less than the outer diameter of the third portion of the main section, wherein the first portion outer diameter has a constant value from the elevator shoulder of the first tool joint to the main section third portion, the main section third portion has a constant outer diameter from the main section first portion to the main section second portion, and wherein the main section third portion has an outer diameter greater than each of the main section first portion and the main section second portion.

2. The landing pipe as claimed in claim 1, wherein the first portion of the main section is integral to the second portion of the main section, with no welds between the main section and both tool joints.

3. The landing pipe as claimed in claim 1, wherein the first tool joint, main section and second tool joint are integral to each other, with no welds therebetween.

4. The landing pipe as claimed in claim 1, wherein the inner diameter of the first portion of the main section is equal to the inner diameter of the second portion of the main section and the outer diameter of the first portion of the main section is greater than the outer diameter of the second portion of the main section.

5. The landing pipe as claimed in claim 4, wherein the outer diameter of the first portion of the main section is 6²⁹⁄₃₂" nominal and the outer diameter of the second portion of the main section is 6⅝" nominal.

6. The landing pipe as claimed in claim 1, wherein a tensile load capacity range for the landing pipe is 1.5 million pounds to 4.5 million pounds.

7. The landing pipe as claimed in claim 1, wherein a material of the landing pipe is a high strength low alloy steel.

8. The landing pipe as claimed in claim 7, wherein the material of the landing pipe has a yield strength range of 135 ksi to 180 ksi over the pipe main section.

9. The landing pipe as claimed in claim 8, wherein the material of the landing pipe has a yield strength range of 150 ksi to 175 ksi over the pipe main section.

10. The landing pipe as claimed in claim 7, wherein the material of the landing pipe has a yield strength range of 120 ksi to 160 ksi over the tool joints.

11. The landing pipe as claimed in claim 10, wherein the material of the landing pipe has a yield strength range of 135 ksi to 150 ksi over the tool joints.

12. The landing pipe as claimed in claim 1, wherein the second portion of the main section has a length range of 55% to 80% of the overall length of the landing pipe.

13. The landing pipe as claimed in claim 1, wherein the wall thickness of the main section second portion is reduced such that a weight reduction for the landing pipe is at least 5% compared to a landing pipe with the main portion first section wall thickness equal to the main portion second section wall thickness.

14. The landing pipe as claimed in claim 1, wherein the second portion of the main section is directly adjacent to the second tool joint.

15. The landing pipe as claimed in claim 1, wherein the threaded portion on at least one of the female threaded portion or male threaded portion has a lower yield strength and decreased hardness compared to the main section.

16. The landing pipe as claimed in claim 15, wherein the lower yield strength and decreased hardness compared to the main section results from a localized heat treatment of the threaded portion.

17. The landing pipe as claimed in claim 1, comprising a yield strength transition area between a low yield strength portion of the first tool joint or the second tool joint and a high yield strength portion of the main section of the landing pipe, said yield strength transition area being located on the first tool joint or the second tool joint and located at least 1" from a taper between the first tool joint or the second tool joint and the main section of the landing pipe.

18. The landing pipe as claimed in claim 17, wherein the yield strength transition area results from a localized heat treatment of the portion of a tool joint.

* * * * *